United States Patent [19]

Hirschberg et al.

[11] 4,378,106

[45] Mar. 29, 1983

[54] REFRACTORY GAS PERMEABLE STRUCTURAL UNIT

[75] Inventors: Bruno Hirschberg, Vienna, Austria; Francois Schleimer, Esch, Luxembourg

[73] Assignee: Arbed S.A., Luxembourg, Luxembourg

[21] Appl. No.: 280,509

[22] Filed: Jul. 6, 1981

[30] Foreign Application Priority Data

Jul. 9, 1980 [LU] Luxembourg ..... 82597

[51] Int. Cl.[3] ..... C21B 7/16

[52] U.S. Cl. ..... 266/265; 75/59; 75/60; 266/218; 266/220

[58] Field of Search ..... 266/265, 220, 218; 75/60, 59

[56] References Cited

U.S. PATENT DOCUMENTS

| | | | |
|---|---|---|---|
| 3,330,645 | 7/1967 | DeMoustier | 75/60 |
| 3,610,602 | 10/1971 | Deacon | 75/59 |
| 3,971,548 | 7/1976 | Folgero | 266/218 |
| 4,053,147 | 10/1977 | Moser | 266/220 |

FOREIGN PATENT DOCUMENTS

| | | | |
|---|---|---|---|
| 1452909 | 10/1976 | United Kingdom | 266/265 |

*Primary Examiner*—P. D. Rosenberg

*Attorney, Agent, or Firm*—Michael J. Striker

[57] ABSTRACT

A refractory gas permeable structural unit for blowing a gas into a metal treatment container and through its casing, has a refractory gas permeable stone, a first metal housing sealingly surrounding the stone, a second metal housing arranged at a distance from the first metal housing, a refractory substantially gas impermeable filler material provided between the first and second metal housings, and at least one connection and a distribution chamber provided at the end face of the stone.

15 Claims, 1 Drawing Figure

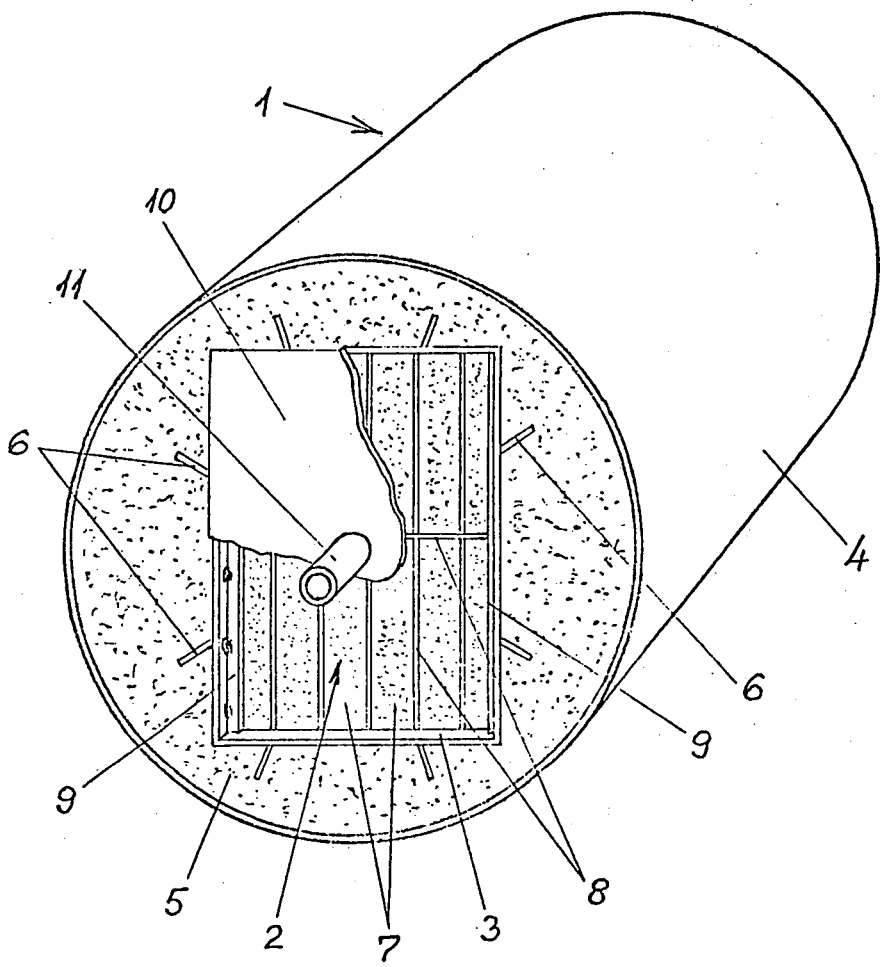
1
10
11
6
4
6
9
9
5
2
7
3
8

REFRACTORY GAS PERMEABLE STRUCTURAL UNIT

BACKGROUND OF THE INVENTION

The present invention relates to refractory gas permeable structural units for blowing a gas into a metal treatment vessel and through its casing.

The oxygen blowing method used in pig iron refining which is known under the names of "LD"—, "LDAC"—, "OLP"—, "BOF"— methods are recently improved, as far as the metallurgy is concerned in that secondary gases are blown under controlled conditions through the container bottom, like nitrogen or argon. Also in other metal treatment containers like ladles for after treatment of steel or electric arc furnaces, the blowing of gas into the metal bath through the bottom of the container or the casing of the container wall is taken into consideration.

In the patent application LU No. 81,208 applicants disclose a device which can be inserted into the bottom of a metal treatment container for blowing a treatment gas into a metal bath, which has a considerably improved stability with respect to the hitherto known gas permeable stones and which permits the blowing of the desired gas quantities. This device essentially consists of a refractory gas permeable structural unit, whereby in an axial direction of the fire proof material, a plurality of flat corrugated pipe like or wire like metallic separating members of a low wall thickness are embedded. In accordance with one embodiment, this structural unit consists of steel sheet metal and segments or strips of fire proof material in alternating arrangement.

In further LU patent applications, applicants have disclosed embodiments and variants of such gas permeable stones. In all of these embodiments the scavenger stone or the segments forming the stone, respectively, are encompassed by a metal housing which sealingly abuts against the longitudinal faces of the stone and, if necessary, with interposition of an intermediate layer of mortar. Thereby, it is achieved that the gas escapes only on the fire side of the stone, and furthermore, the undesirable and uncontrollable gas passage along the metal housing is eliminated.

These scavenger stones or the segments forming the stone are made by extrusion of fire proof material, as a rule, to which a stone fire may be connected. In accordance with this manufacturing technique, the scavenger stones and therefore the encompassing metal housings have a rectangular or square cross-section.

Because of this cross-sectional shape, a swelling of the metal housing may occur at higher gas pressures, whereby the metal housing is lifted off this scavenger stone so as to create an undesirable gap between the stone and the metal housing. The metal melt (pig iron or steel) may penetrate into this gap and the danger exists that the melt may penetrate to the cold side of the stone.

Moreover, the danger exists that the metal housing which consists of steel sheet metal is subjected to structural changes by absorbing carbon or nitrogen from the surrounding carbon containing masonry of the furnace or from the atmosphere, respectively, which impairs its stability.

SUMMARY OF THE INVENTION

Accordingly, it is an object of the present invention to provide a refractory gas permeable structural unit for blowing a gas into a metal treatment vessel and through its casing, which avoids the disadvantages of the prior art. which will become apparent hereinafter, one feature of the present invention resides, briefly stated, in a fire proof gas permeable stuctural unit which has a gas permeable fire proof stone, a first metal housing sealingly surrounding said stone, with interposition of a mortar layer if necessary, a second metal housing arranged at a distance from said first metal housing, a fire proof substantially gas impermeable filler material provided between the first and second metal housings, and at least one connection and distribution chamber provided at an end face of the stone.

When the fire proof gas permeable structural unit is designed in accordance with the present invention, the filler material and the second metal housing which encompasses the first metal housing protect it from deformation under the action of the gas pressure, as well as from carbonization and nitrogenization.

In accordance with another feature of the present invention, the second outer metal housing has advantageously a cylindrical or truncated cone shape with a circular cross-section which eliminates the danger that it can be deformed. Moreover, it is possible to use the structural unit in such cases when scavenger stones with a circular cross-section are required, for example in ladles. Since the first inner metal housing is protected from deformations under the action of gas pressure, it is not disturbing if it has a rectangular or square cross-section as desired for a rational manufacturing of the scavenger stone.

For securing the scavenger stone against falling out of the encasing, sheet metal plates may be provided on the first inner metal housing more particularly in the area which is close to its gas supply, that is on the cold side area the metal plates may become, for example, welded to the first housing and extend for anchoring reasons into the fire proof filler material. Such metal plates may be mounted in the same manner on the second outer metal housing, which extend outwardly. When the structural unit is inserted approximately into a bottom of the furnace, the sheet metal plates can extend into a tamping clay which encompasses the structural unit between the gas permeable structural unit and the bottom stones.

In accordance with a further feature of the present invention, the gas permeable fire proof scavenger stone which is located inside the first metal housing, may consist of individual segments which abut against one another along their longitudinal faces, with interposition of intermediate metal layers or inserts if necessary. The scavenger stone of the segments, respectively, may be provided with advantageously coextruded pairs of sheet metal whereby the gas passage takes place in the slot between the sheet metal of a pair. Moreover, the abutting longitudinal faces of the segments may be provided with profiles, such as grooves or corrugations, for increasing the gas permeability of the stones.

The scavenger stone or segments which form the stone, respectively, may be composed of fire proof sintered or non-sintered material such as sinter magnesia, mixture of magnesia and chrome ore, prereacted magnesia-chrome or - sinter granules, high-alumina material, bound with a carbon carrier, such as tar, pitch, plastic resin or bound chemically.

These fire proof solid materials are also suitable for the filler material which is provided with a chemical or a carbon-containing binder and arranged as a tamper material or casting material between two metal housings.

As a material for the metal housings, sheet metal is particularly suitable, for example, with a thickness of between 1 and 3 mm.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

The single FIGURE of the drawing is a view showing a fire proof gas permeable structural unit for blowing gas into a metal treatment container and through its casing, in accordance with the present invention.

DESCRIPTION OF PREFERRED EMBODIMENTS

A refractory gas permeable structural unit for blowing a gas into a metal treatment container and through its casing, in accordance with the present invention, is identified by reference numeral 1 and includes a scavenger stone identified by reference numeral 2. The scavenger stone 2 is surrounded by a first inner metal housing 3 having a rectangular cross-section.

A second outer metal housing 4 having a circular cross-section is arranged in a spaced relationship relative to the first inner metal housing 3. The space between the metal housings 3 and 4 is filled with a fire proof filler material 5. Sheet metal plates 6 are welded onto the inner metal housing 3 and extend for anchoring reasons into the fire proof filler material 5.

The scavenger stone 2 located inside the first metal housing 3 consists of twelve prefabricated segments 7 made of fire proof material and arranged into rows each including six segments. Sheet metal plates 8 are inserted into the gaps between the segments 7 so that the gas passage takes place therealong.

The segments 7 are mounted on the inner side of the first metal housing 3 by means of strips 9, advantageously by point welding, at a distance from the end side of the first metal housing 3. This end face forms together with the respective face of the filler material 5 located in one plane, a cold side of the structural unit 1. A plate 10 is sealingly welded to this end side. The plate 10 which is shown in the drawing partially broken off, is provided with a pipe connection 11 so that the gas is supplied into a remaining distribution chamber formed between the plate 10 and the end side of the scavenger stone 2.

As a filler material 5, a mass of sinter magnesia, for example, having the composition and granule structure may be used:

| Composition | Granule |
|---|---|
| MgO 96.2 weight percent | 3–5 mm 15 weight percent |
| $Cr_2O_3$ 0.2 weight percent | 1–3 mm 40 weight percent |
| $Al_2O_3$ 0.1 weight percent | 0–1 mm 20 weight percent |
| CaO 2.5 weight percent | 0–0.1 mm 25 weight percent |
| $SiO_2$ 1.0 weight percent. | |

The filler material which is provided with a chromate-binder, for example, with an addition of 4.5 by weight water may be placed in the space between the two metal housings 3 and 4 as a tamping mass and tamped there.

With an addition of eight weight percent of water, relative to the dry mass, the material in the space between the two metal housings 3 and 4 can be compressed by means of an inner jolter introduced into the material. With a higher addition of water, the material can be used as a casting material.

It will be understood that each of the elements described above, or two or more together, may also find a useful application in other types of constructions differing from the types described above.

While the invention has been illustrated and described as embodied in a fire proof gas permeable structural unit it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A refractory gas permeable structural unit for blowing gas into a metal treatment vessel and through its casing and insertable in the vessel, the structural unit comprising a gas permeable refractory stone having a gas inlet end face; a first metal housing sealingly surrounding said stone; means forming at least one gas supply connection for supplying gas toward said end face of said gas permeable refractory stone; means forming a gas distributing chamber between said gas supply connection and said end face of said gas permeable refractory stone, so that gas is supplied by said gas supply connection into said distributing chamber and travels from the latter through said gas permeable refractory stone surrounded by said first metal housing; a second metal housing arranged at a distance from said first metal housing; and a refractory substantially gas impermeable filler material provided between said first and second metal housings so as to prevent swelling of said first metal housing and absorption by said first metal housing of carbon or nitrogen from the surrounding vessel.

2. A structural unit as defined in claim 1, and further comprising an intermediate mortar layer provided between said stone and said first metal housing.

3. A structural unit as defined in claim 1, wherein said gas permeable refractory stone is composed of a plurality of elements having longitudinal faces and abutting against one another along said longitudinal faces.

4. A structural unit as defined in claim 3, wherein said gas permeable refractory stone further has a plurality of intermediate metal layers provided between said elements.

5. A structural unit as defined in claim 3, wherein said gas permeable refractory stone further has a plurality of inserts provided between said elements.

6. A structural unit as defined in claim 1, wherein said first metal housing surrounding said gas permeable refractory stone has a rectangular cross section.

7. A structural unit as defined in claim 1, wherein said first metal housing surrounding said gas permeable refractory stone has a square cross-section.

8. A structural unit as defined in claim 1, wherein said second metal housing which is spaced from said first metal housing has a cylindrical shape.

9. A structural unit as defined in claim 1, wherein said second metal housing which is spaced from said first metal housing has a truncated cone shape.

10. A structural unit as defined in claim 1, wherein said first metal housing is provided with anchoring members extending into said refractory filler material.

11. A structural unit as defined in claim 10, wherein said anchoring members are formed as sheet metal plates.

12. A structural unit as defined in claim 10, wherein said first metal housing has a region adjacent to a gas supply, said anchoring members being provided in said region.

13. A structural unit as defined in claim 1, wherein said gas permeable refractory stone has an axis, said first and second housings being spaced from one another in a direction which is transverse to said axis, said first and second housings having axial lengths substantially corresponding to each other.

14. A structural unit as defined in claim 13, wherein said refractory filler material has a length substantially corresponding to the lengths of said first and second housings, said gas permeable refractory stone having a length which is smaller than the length of said first and second housings.

15. A structural unit as defined in claim 14, wherein said refractory filler material is a substantially uniform refractory mass.

* * * * *